US007127868B2

(12) United States Patent
Purvis et al.

(10) Patent No.: US 7,127,868 B2
(45) Date of Patent: Oct. 31, 2006

(54) GUARDRAIL SYSTEM FOR A ROOF OF A BUILDING AND ASSOCIATED METHODS

(75) Inventors: Harrison G. Purvis, 8745 Hwy. 705, Eagle Springs, NC (US) 27242; Philip Weathers, Fuquay Varina, NC (US)

(73) Assignee: Harrison G. Purvis, Eagle Springs, NC (US)

( * ) Notice: Subject to any disclaimer, the term of this patent is extended or adjusted under 35 U.S.C. 154(b) by 294 days.

(21) Appl. No.: 10/613,510

(22) Filed: Jul. 3, 2003

(65) Prior Publication Data

US 2004/0103589 A1 Jun. 3, 2004

Related U.S. Application Data

(60) Provisional application No. 60/398,657, filed on Jul. 26, 2002.

(51) Int. Cl.
*E04B 1/00* (2006.01)
*E04G 21/00* (2006.01)
*E04G 23/00* (2006.01)

(52) U.S. Cl. ..... 52/746.11; 52/DIG. 12; 52/749.12; 182/82; 182/106

(58) Field of Classification Search ..... 52/24, 52/DIG. 12, 746.11, 749.11; 182/82, 45, 182/150, 106, 113; 256/59, DIG. 6; 248/237, 248/148
See application file for complete search history.

(56) References Cited

U.S. PATENT DOCUMENTS 3,158,223 A * 11/1964 Brown ..... 182/36
3,740,022 A * 6/1973 DiGiovanni ..... 256/24
3,863,899 A * 2/1975 Werner ..... 256/24
3,995,833 A * 12/1976 McLaughlin et al. ..... 256/59
4,666,131 A * 5/1987 Kettelkamp et al. ..... 256/59
4,909,483 A * 3/1990 van Herpen ..... 256/59
4,946,123 A 8/1990 Albert
4,957,185 A * 9/1990 Courchesne et al. ..... 182/150
5,145,030 A 9/1992 Pavlescak et al.
5,203,428 A 4/1993 Beeche
5,259,477 A * 11/1993 Fears et al. ..... 182/82
5,553,685 A 9/1996 Cook (Continued)

OTHER PUBLICATIONS

BlueWater Manufacturing, "Safetyrail 2000", © 2003; pp. 1-2.

(Continued)

*Primary Examiner*—Carl D. Friedman
*Assistant Examiner*—Chi Q. Nguyen
(74) *Attorney, Agent, or Firm*—Allen, Dyer, Doppelt, Milbrath & Gilchrist, P.A.

(57) ABSTRACT

A guardrail system for a pitched roof of a building including a plurality of pitched roof members includes a plurality of end post supports that may be installed from ground level. Each of the end post supports may include a U-shaped body having a first segment for removably fastening to an end of a respective roof member, and having a second segment extending outwardly from the respective roof member with a gap therebetween defined by the U-shape. The end post supports may also include a post receiver connected to an upper end of the second segment of the U-shaped body, and a stabilizer carried by the U-shaped body for extending against an adjacent wall portion below the pitched roof. The guardrail system may further include a respective post carried by the post receiver of each end post support, and rail members to be connected between adjacent end posts.

51 Claims, 3 Drawing Sheets

U.S. PATENT DOCUMENTS

| | | | | |
|---|---|---|---|---|
| 5,570,559 | A * | 11/1996 | Lewis | 52/749.12 |
| D377,751 | S | 2/1997 | Koebbe | |
| 5,638,917 | A | 6/1997 | Vennen | |
| 5,683,074 | A | 11/1997 | Purvis et al. | |
| 5,711,398 | A | 1/1998 | Bartholomew | |
| 5,730,246 | A | 3/1998 | Beard | |
| 5,829,549 | A | 11/1998 | Flynn | |
| 6,039,150 | A | 3/2000 | Palmer | |
| 6,233,894 | B1 | 5/2001 | Abney et al. | |
| 6,276,668 | B1 * | 8/2001 | Sweeley | 256/59 |
| 6,279,880 | B1 * | 8/2001 | Hawks, Jr. | 256/67 |
| 6,345,689 | B1 * | 2/2002 | McNamee | 182/45 |
| 6,585,080 | B1 * | 7/2003 | Murray | 182/45 |
| 6,908,075 | B1 * | 6/2005 | Nichols | 256/59 |
| 2003/0042072 | A1 * | 3/2003 | Murray | 182/45 |
| 2004/0007423 | A1 * | 1/2004 | Scott | 182/82 |

OTHER PUBLICATIONS

Pro-Bel Enterprises Ltd., "Safety Guardrails—Suspended Equipment & Fall Protection Experts", pp. SG-2 to SG-3.

Acro Building Systems; "Tools & Equipment Roofing Guardrail System 12070"; © 1998; pp. 1-5.

Fall Protection Systems, Inc., "The Truss Setter System", May 15, 2003; pp. 1-2.

* cited by examiner

GUARDRAIL SYSTEM FOR A ROOF OF A BUILDING AND ASSOCIATED METHODS

RELATED APPLICATIONS

This application claims the benefit of U.S. Provisional Patent Application Ser. No. 60/398,657 filed on Jul. 26, 2002, the entire disclosure of which is incorporated herein by reference.

FIELD OF THE INVENTION

The present invention relates to the field of building construction and, more particularly, to the field of guardrails for use during construction.

BACKGROUND OF THE INVENTION

A pitched rooftop of a building may be hazardous to workers performing work thereon, such as roofers, for example. In some cases, a worker performing work on the rooftop may slip on the pitched roof, causing the worker to slide down the roof and, in some cases, fall from the rooftop. Accordingly, it may be desirable to provide guardrails adjacent an edge of the rooftop to provide a barrier at the edge of the roof that may prevent the worker from falling from the rooftop.

Temporary guardrails may be constructed adjacent a rooftop with materials commonly found on a construction site, such as excess wood, for example. A platform is generally built adjacent the edge of the rooftop, and is braced against a wall supporting the rooftop. Spaced apart guardrail posts are connected to the platform and extend upwardly therefrom, and rails are extended between the guardrail posts to form a barrier adjacent the edge of the rooftop. A skid-guard, or kickplate, may be connected between the guardrail posts to provide a barrier adjacent the edge of the roof.

Although this type of guardrail system may be effective, installation may be expensive, time inefficient, and itself hazardous. More specifically, the guardrail system is generally installed after roof members have been elevated and connected to top portions of support walls. Installation of the guardrail system is performed at, or near, the elevation of the rooftop, before fall protection is provided. In other words, the installers may be working off of ladders, where fall protection, such as guardrails, has not yet been provided.

One example of a guardrail system for a pitched roof is disclosed in U.S. Pat. No. 5,711,398 to Bartholomew. The guardrail system includes a plurality of spaced apart rail support assemblies aligned along an edge of a pitched roof, and a plurality of rails extending between the support assemblies. Each of the rail support assemblies includes a hinged base that is anchored into the roof with a hook so that the base may be positioned on the rooftop.

This roofing system is typically used, however, during the installation of roofing material, or during repair of roofing material, i.e., after plywood has been placed over the roof members. Accordingly, since the roofing system is installed after the rooftop has been laid over the roof members, i.e., at the elevation of the rooftop, the installer is at risk for falling from the roof before the guardrail system is completely installed.

The Roof-Rail Company offers another type of guardrail system under the designation, "ROOF-RAIL Guardrail Brackets". This type of guardrail system includes a bracket that is fastened to a spacer, which, in turn, is fastened to a building wall. Braces are then connected to the bracket to support a post socket. Posts and rails may then be constructed of wood material, and supported by the brackets fastened to the building wall.

A particularly advantageous guardrail system is disclosed in U.S. Pat. No. 5,683,074 to Purvis et al. The temporary guardrail system includes an anchor bracket that is fastened into portions of a roof, and a plurality of modular portions that are connected to form the guardrail system. Again, this system is installed after the roof is installed.

SUMMARY OF THE INVENTION

In view of the foregoing background, it is therefore an object of the present invention to provide a roof guardrail system that can be efficiently installed. It is another object of the present invention to provide a roof guardrail system that can be installed at ground level, if desired.

These and other objects, features, and advantages of the present invention are provided by a guardrail system including a plurality of end post supports, posts and rail members. More specifically, the guardrail system is for a pitched roof of a building comprising a plurality of pitched roof members. The plurality of end post supports may be connected to the pitched roof members while still at ground level. Further, the posts may also be connected while at ground level. Accordingly, the pitched roof members having the end post supports and posts connected thereto may advantageously be elevated and connected to a wall. The guardrail system may also be installed from an elevated platform after the pitched roof members have been elevated and connected to the wall. In other words, the guardrail system may advantageously be installed after the pitch roof members have been connected without exposing an installer to the top of a pitched roof that does not have a guardrail system installed thereon.

The plurality of end post supports may each comprise a U-shaped body having a first segment for removably fastening to an end of a respective pitched roof member. The U-shaped body may also have a second segment extending outwardly from the respective pitched roof member with a gap therebetween defined by the U-shape. The end post support may further comprise a post receiver connected to an upper end of the second segment of the U-shaped body, and a stabilizer carried by the U-shaped body for extending against an adjacent wall portion below the pitched roof. The guardrail system may comprise a respective post carried by the post receiver of each end post support, and rail members connected between adjacent posts.

The first segment of the U-shaped body may have a plurality of openings therein to receive respective removable fasteners. The stabilizer may comprise an elongate stabilizer member, and a stabilizer receiver connected to the U-shaped body for adjustably receiving the elongate stabilizer member therein. The guardrail system may also comprise a transverse stabilizer member connected to an end of the elongate stabilizer member. The stabilizer, and the transverse stabilizer member advantageously enhance stability of the end post support when installed on the pitched roof member.

The guardrail system may further comprise a kick member bracket carried by the upper end of the second segment of the U-shaped body for receiving a kick member therein. The kick member advantageously provides a barrier along an edge of the pitched roof.

The guardrail system may further comprise a plurality of gable post supports to advantageously enhance the perimeter of the guardrail system. The plurality of gable post supports may also advantageously be connected to the pitched roof members from ground level. Similarly, rail members may be extended between adjacent gable post supports, and between end posts supports and gable post supports on a common pitched roof member from ground level so that when the pitched roof members are elevated, a barrier around an edge of the pitched roof is in place.

Each of the gable post supports may comprise a body having a first end for removably fastening to a pitched roof member along a gable portion thereof, and a gable post receiver carried by the body. Each gable post support may also comprise a respective post carried by the gable post receiver of each gable post support, and rail members connected between adjacent posts. The posts and rail members may also be installed at ground level.

The body may comprise a gable plate to be removably connected to the pitched roof member, and an elongate gable member extending outwardly from the gable plate. The gable post receiver may be selectively positionable along the elongate gable member to allow a user to set the distance from the roof that the posts and rail members are positioned.

Each gable post support may further comprise a stabilizer carried by a second end of the body for extending against an adjacent wall portion below the pitched roof. The stabilizer may comprise an elongate stabilizer member, and a stabilizer receiver connected to the body for adjustably receiving the elongate stabilizer member therein. A transverse stabilizer member may be connected to an end of the elongate stabilizer member to enhance the stability of the gable post support.

A method aspect of the present invention is for installing a guardrail system on a pitched roof of a building. The method may comprise connecting a plurality of end post supports, as described above, to an end of a respective roof member. The method may further comprise connecting a respective post to the post receiver of each end post support, and connecting rail members between adjacent posts.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
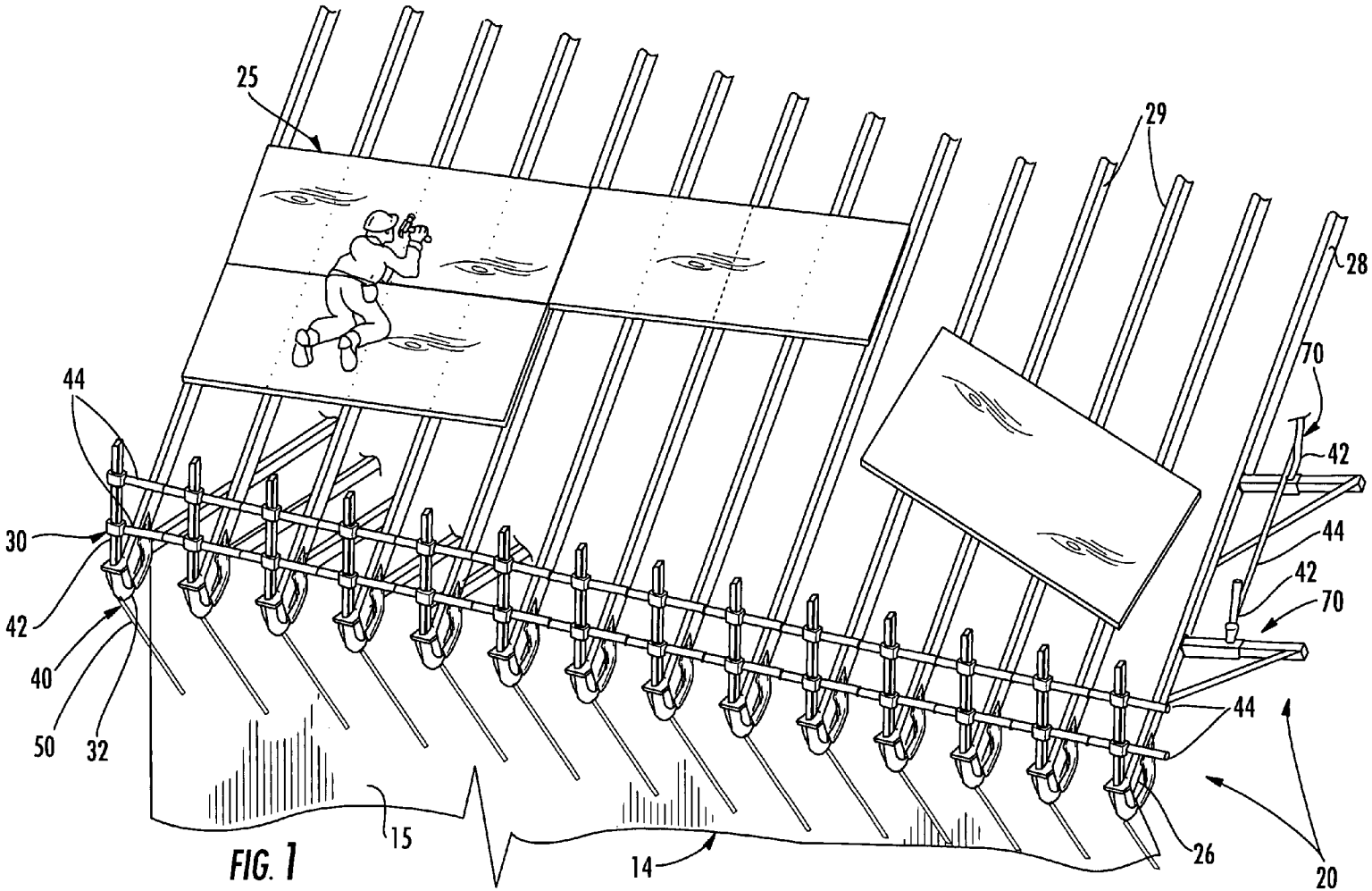
FIG. 1 is a perspective view of a guardrail system installed on a building according to the present invention.
Figure 2:
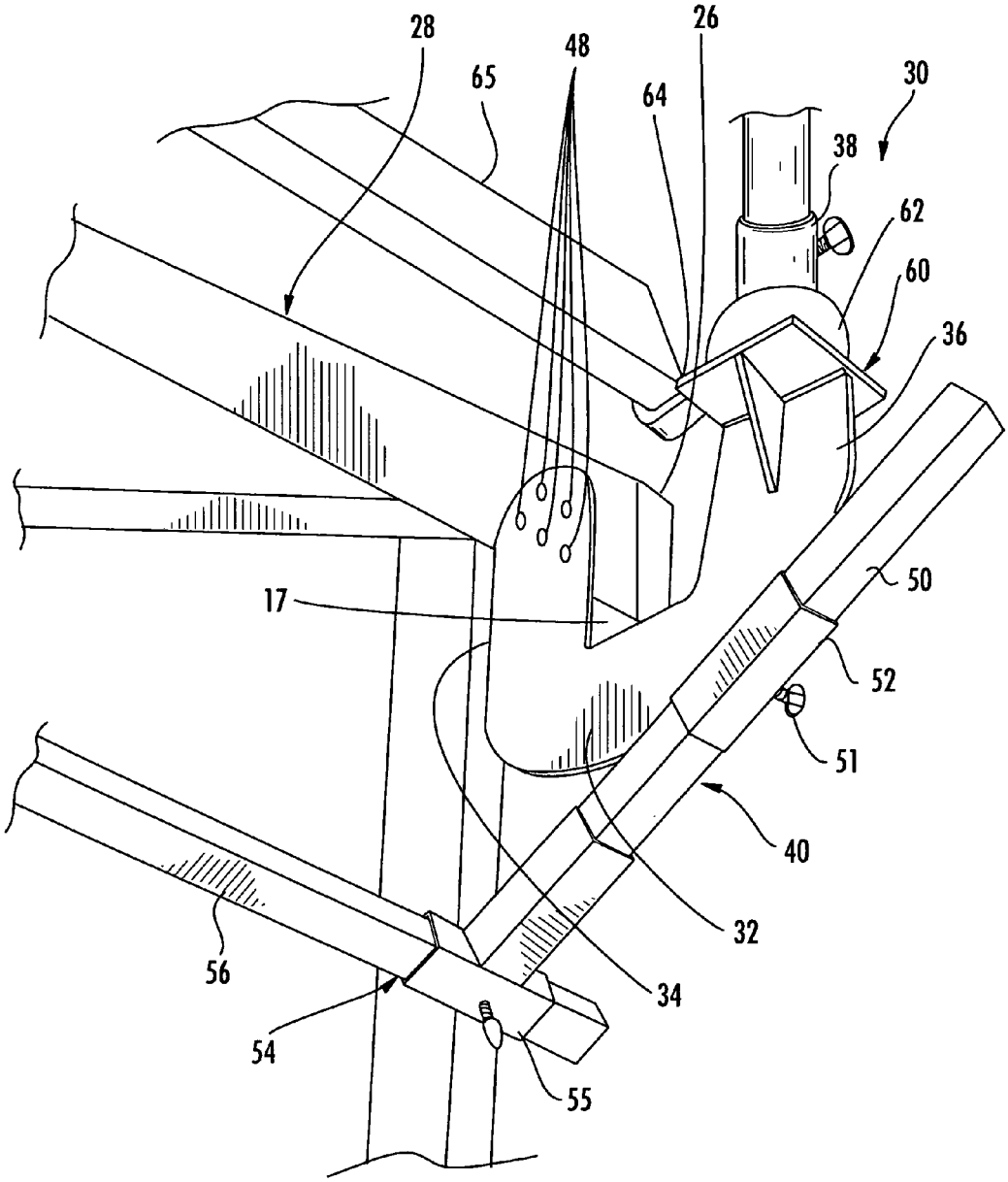
FIG. 2 is a more detailed perspective view of a portion of the guardrail system shown in FIG. 1.
Figure 3:
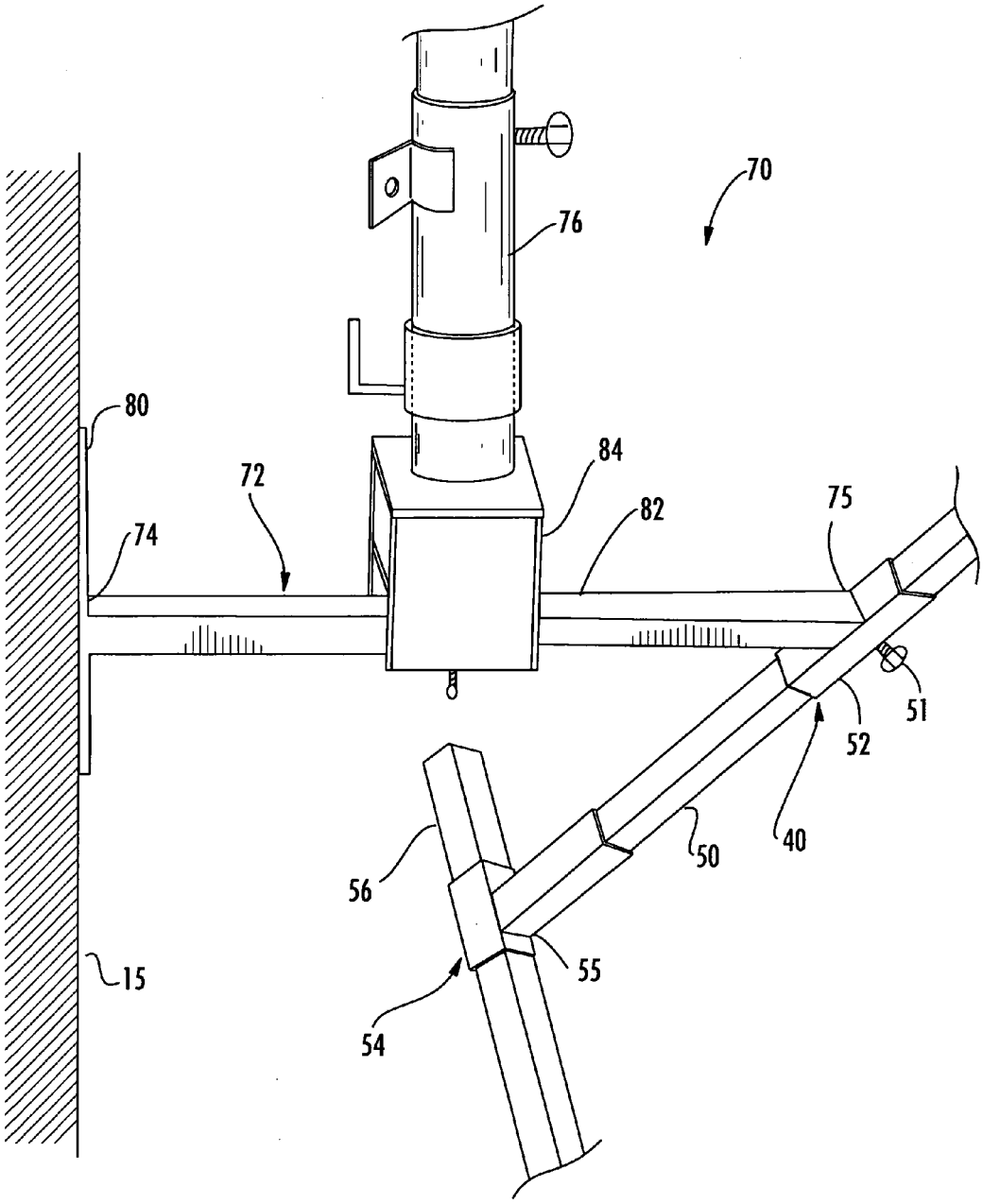
FIG. 3 is a more detailed perspective view of another portion of the guardrail system shown in FIG. 1.

Referring to FIGS. 1–3, a guardrail system 20 according to the present invention is now described. The guardrail system 20 is illustratively for a pitched roof 25 of a building 14. The pitched roof 25 illustratively comprises a plurality of pitched roof members 28, 29. More specifically, the pitched roof members 28, 29 may include a pair of opposing end pitched roof members 28 and a plurality of spaced-apart medial pitched roof members 29 between the pair of end roof members. The pitched roof members 28, 29 may also be made of steel, for example, or any other type of material, as understood by those skilled in the art. The end roof members 28 generally form a sidewall of the pitched roof 25. The pitched roof members 28, 29 may be prefabricated trusses, for example, or another type of pitched roof member, as understood by those skilled in the art.

The guardrail system 20 of the present invention may be efficiently installed using minimal labor. For example, a pair of installers is generally sufficient to install the guardrail system 20 on a pitched roof 25 of a building 14. The guardrail system 20 is also advantageously installable at ground level. In other words, the guardrail system 20 may be connected to the pitched roof members 28, 29 before the pitched roof members are elevated to their final positions, i.e., atop a support wall. Those skilled in the art will appreciate, however, that the guardrail system 20 may also advantageously be installed from an elevated platform, such as a step ladder, for example, after the pitched roof members 28, 29 have been elevated. This is advantageous because it prevents the need for an installer to be atop the pitched roof 25 without a barrier being installed along an edge of the pitched roof.

The guardrail system 20 illustratively comprises a plurality of end post supports 30. Referring more specifically to FIG. 2 an end post support 30 is now described in greater detail. Each end post support 30 comprises a U-shaped body 32 having a first segment 34 for removably fastening to an end of a respective pitched roof member 28, 29. The end post support 30 also has a second segment 36 extending outwardly from the respective pitched roof member 28, 29 with a gap 17 therebetween defined by the U-shape. The gap 17 allows ready positioning of a board over the ends of the pitched roof members 28, 29 with the guardrail system 20 in place.

A post receiver 38 is connected to an upper end of the second segment 36 of the U-shaped body 32. The U-shaped body 32 illustratively carries a stabilizer 40 for extending against an adjacent wall portion 15 below the pitched roof 25. The post receiver 38 of the end post support 30 carries a respective post 42. A plurality of rail members 44 are connected between adjacent posts 42. The rail members 44 are advantageously adjustable in length to accoimnodate varying distances between the posts 42.

The first segment 34 of U-shaped body 32 has a plurality of openings therein to receive respective removable fasteners 48. The removable fasteners 48 may, for example, be bolts, large wood screws, or another type of removable fastener.

The stabilizer 40 illustratively comprises an elongate stabilizer member 50, and a stabilizer receiver 52 connected to the U-shaped body 32 for adjustably receiving the elongate stabilizer member therein. The stabilizer receiver 52 may, for example, be a tube having a size slightly larger than the size of the stabilizer member 50, and an inner peripheral shape substantially similar to the shape of the outer periphery of the stabilizer member. The stabilizer member 50 may be a bar, for example, that slides between extended and retracted positions within the stabilizer receiver 52.

The stabilizer receiver 50 may have a passageway therein and a fastener 51 for locking the stabilizer member 50 in the stabilizer receiver. The passageway is preferably a threaded passageway, and the fastener 51 is preferably a thumbscrew, but may be any other type of fastener, as understood by those skilled in the art.

The guardrail system 20 also illustratively comprises a kick member bracket 60 carried by the upper end of the second segment 36 of the U-shaped body 32 for receiving a kick member 65 therein. The kick member bracket 60 includes a sleeve 62 that is carried by the upper end of the second segment 36 of the U-shaped body 32. An L-shaped member 64 is connected to the sleeve 62. The connection between the L-shaped member 64 and the sleeve 62 may, for example, be a welded connection, or any other connection, as understood by those skilled in the art. The L-shaped member 64 has a plurality of passageways formed in an upper portion thereof for receiving a respective plurality of fasteners.

The kick member 65 preferably comprises wood material, such as a 2"×4" board, but may also comprise other material. The kick member 65 may be fastened to the L-shaped member 64 using fasteners, such as wood screws, for example. The kick member 65 advantageously provides a raised barrier along the edge of the pitched roof 25.

Referring now additionally to FIG. 3, another aspect of the guardrail system 20 is now described. The guardrail system 20 illustratively comprises a plurality of gable post supports 70. Each gable post support 70 illustratively comprises a body 72 having a first end 74 for removably fastening to roof members 28, 29 along a gable portion thereof. Each gable post support 70 also comprises a post receiver 76 carried by the body 72. A post 42 is carried by the post receiver 76. The gable post support 70 also comprises rail members 44 to be connected between adjacent posts 42 or adjacent gable post supports.

The body 72 comprises a gable plate 80 to be removably connected to the roof member 28, 29. The gable plate 80 is preferably a rectangular plate, but may have any other shape, as understood by those skilled in the art. The gable plate 80 also has a plurality of fastener passageways formed therein for receiving a plurality of fasteners (not shown). More specifically, the plurality of fasteners may include a plurality or wood screws or bolts, for example, or any other type of fastener that may be readily used to fasten the gable plate 80 to the gable portion of the pitched roof member 28, 29.

An elongate gable member 82 illustratively extends outwardly from the gable plate 80. The connection between the elongate gable member 82 and the gable plate 80 may, for example, be a welded connection, or any other type of connection, as understood by those skilled in the art.

The gable post receiver 76 is selectively positionable along the elongate gable member 82. More specifically, the gable post receiver illustratively 76 includes a generally rectangular body 84. Portions of the generally rectangular body 84 may slidably engage the elongate gable member 82. The generally rectangular body 84 may include a passageway along a bottom portion thereof for receiving a fastener to fasten the post receiver 76 in a position along the elongate gable member 82. The passageway is preferably a threaded passageway, and the fastener is preferably a thumb screw, for example, or another fastener that is compatible with the threaded passageway.

The gable post support 70 further comprises a stabilizer 40 carried by a second end 75 of the body 72 for extending against an adjacent wall portion below the pitched roof 25. The stabilizer 40 for the gable post support 70 is similar to the stabilizer for the end post support 30 and, accordingly, requires no further discussion herein. A transverse stabilizer member 54 is connected to an end of the elongate stabilizer member 50. The transverse stabilizer member 54 for the gable post support 70 is similar to the transverse stabilizer for the end post support 30 and, accordingly, requires no further discussion herein.

A method aspect of the present invention is for installing a guardrail system 20 on a pitched roof 25 of a building. The method comprises connecting a plurality of end post supports 30 to ends of respective roof members 28, 29, and connecting a respective end post 42 to each of the post receivers 38 of each end post support. The method also includes connecting rail members 44 between adjacent posts 42.

Installation of the guardrail system 20 may be accomplished in a number of different ways. For example, when installing the guardrail system 20 on the end pitched roof member 28, installation may advantageously be accomplished at ground level. More specifically, the end post supports 30 may advantageously be connected to opposing ends of the end pitched roof member 28. A plurality of gable post supports 70 may then be connected to a medial portion of the end pitched roof member 28.

After the guardrail system 20 is installed along the end pitched roof member 28, the end pitched roof member 28 may be elevated to be supported on a wall of the building. Accordingly, when the end pitched roof member 28 is elevated to the top of the wall, the guardrail system 20 is already in place. This advantageously prevents the need for an installer to be on the pitched roof 28, 29 to install the guardrail system 20.

After the guardrail system 20 has been installed along the end pitched roof members 28, the remainder of the guardrail system may be installed. More specifically, a plurality of end post supports 30 may be connected to opposing ends of the medial pitched roof members 29. This can be accomplished from an elevated platform, such as a step-ladder, for example. Again, this advantageously prevents the need for the installer to be on the pitched roof 28, 29 to install the guardrail system 20.

While installing the end post supports 30 on the opposing ends of the medial pitched roof members 29, the installer may connect a portion of the end post support to himself/herself to prevent the end post support from falling from the elevated surface. The connection may, for example, be a chain having a connector on an end thereof.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included within the scope of the appended claims.

That which is claimed is:

1. A combination of a pitched roof of a building and a guardrail system therefor comprising:

said pitched roof comprising a plurality of pitched roof members;

said guardrail system comprising a plurality of end post supports each comprising a U-shaped body having a first segment removably fastened to an end of a respective pitched roof member and having a second segment extending outwardly from the respective pitched roof member with a gap therebetween defined by the U-shape, a post receiver connected to an upper end of the second segment of said U-shaped body, and a stabilizer carried by said U-shaped body for extending against an adjacent wall portion below the pitched roof;

a respective post carried by the post receiver of each end post support; and rail members connected between adjacent posts.

2. A combination according to claim 1 wherein the first segment of said U-shaped body has a plurality of openings therein to receive respective removable fasteners.

3. A combination according to claim 1 wherein said stabilizer comprises:

an elongate stabilizer member; and a stabilizer receiver connected to said U-shaped body for adjustably receiving said elongate stabilizer member therein.

4. A combination according to claim 3 further comprising a transverse stabilizer member connected to an end of said elongate stabilizer member.

5. A combination according to claim 1 further comprising a kick member bracket carried by the upper end of the second segment of said U-shaped body for receiving a kick member therein.

6. A combination according to claim 1 further comprising:

a plurality of gable post supports, each comprising a body having a first end for removably fastening to a pitched roof member along a gable portion thereof, and a post receiver carried by said body;

a respective post carried by the post receiver of each gable post support; and rail members connected between adjacent posts.

7. A combination according to claim 6 wherein said body comprises a gable plate to be removably connected to the pitched roof member, and an elongate gable member extending outwardly from said gable plate.

8. A combination according to claim 7 wherein said post receiver is selectively positionable along said elongate gable member.

9. A combination according to claim 6 wherein each gable post support further comprises a stabilizer carried by a second end of the body for extending against an adjacent wall portion below the pitched roof.

10. A combination according to claim 9 wherein said stabilizer comprises;

an elongate stabilizer member; and a stabilizer receiver connected to said body for adjustably receiving said elongate stabilizer member therein.

11. A combination according to claim 10 further comprising a transverse stabilizer member connected to an end of said elongate stabilizer member.

12. A combination of a pitched roof of a building and an end post support for a guardrail system for the pitched roof of the building, the combination comprising:

said pitched roof comprising a plurality of pitched roof members;

said end post support comprising a U-shaped body having a first segment removably fastened to an end of a pitched roof member of the pitched roof, and having a second segment extending outwardly from the roof member with a gap therebetween defined by the U-shape;

a post receiver connected to an upper end of the second segment of said U-shaped body; and a stabilizer carried by said U-shaped body for extending against an adjacent wall portion below the pitched roof.

13. A combination according to claim 12 wherein the first segment of said U-shaped body has a plurality of openings therein to receive respective removable fasteners.

14. A combination according to claim 12 wherein said stabilizer comprises:

an elongate stabilizer member; and a stabilizer receiver connected to said U-shaped body for adjustably receiving said elongate stabilizer member therein.

15. A combination of a pitched roof of a building and a gable post support for a guardrail system for the pitched roof of the building, the combination comprising:

a pitched roof comprising a plurality of pitched roof members including a plurality of end pitch roof members adjacent respective gable portion of the pitch roof;

said gable post comprising a body having a first end removably fastened to an end pitched roof member along a side thereof;

a post receiver carried by said body; and a stabilizer carried by a second end of the body for extending against an adjacent wall portion below the pitched roof gable portion.

16. A combination according to claim 15 wherein said body comprises a gable plate to be removably connected to the pitched roof member, and an elongate gable member extending outwardly from said gable plate.

17. A combination according to claim 16 wherein said post receiver is selectively positionable along said elongate gable member.

18. A combination according to claim 15 wherein said stabilizer comprises:

an elongate stabilizer member; and a stabilizer receiver connected to said body for adjustably receiving said elongate stabilizer member therein.

19. A method of installing a guardrail system on a pitched roof of a building, the pitched roof comprising a plurality of pitched roof members, the method comprising:

connecting a plurality of end post supports to ends of respective pitched roof members, each end post support comprising a U-shaped body having a first segment removably fastened to the end of the respective pitched roof member and having a second segment extending outwardly from the respective pitched roof member with a gap therebetween defined by the U-shape, a post receiver connected to an upper end of the second segment of the U-shaped body, and a stabilizer carried by the U-shaped body and extending against an adjacent wall portion below the pitched roof;

connecting a respective post to the post receiver of each end post support; and connecting rail members between adjacent posts.

20. A method according to claim 19 wherein the first segment of the U-shaped body has a plurality of openings therein to receive respective removable fasteners.

21. A method according to claim 19 wherein the stabilizer comprises an elongate stabilizer member; and further comprising adjustably receiving the elongate stabilizer member in a stabilizer receiver connected to the U-shaped body.

22. A method according to claim 21 further comprising connecting a transverse stabilizer member to an end of the elongate stabilizer member.

23. A method according to claim 19 further comprising connecting a kick member bracket to the upper end of the second segment of the U-shaped body for receiving a kick member therein.

24. A method according to claim 19 further comprising removably fastening a plurality of gable post supports to the pitched roof members along a gable portion thereof.

25. A method according to claim 24 wherein each of the plurality of gable post supports comprises;

a body having a first end for removably fastening to roof members along a gable portion thereof; and a post receiver carried by the body.

26. A method according to claim 25 wherein the body comprises a gable plate to be removably connected to the roof member; and further comprising extending an elongate gable member outwardly from the gable plate.

27. A method according to claim 26 further comprising selectively positioning the post receiver along the elongate gable member.

28. A method according to claim 25 wherein each gable post support further comprises a stabilizer carried by a second end of the body; and further comprising extending the stabilizer against an adjacent wall portion below the pitched roof.

29. A method according to claim 28 wherein the stabilizer comprises an elongate stabilizer member; and further comprising adjustably receiving the elongate stabilizer member in a stabilizer receiver connected to the body.

30. A method according to claim 29 further comprising connecting a transverse stabilizer member to an end of the elongate stabilizer member.

31. A method according to claim 19 further comprising connecting the plurality of end post supports to ends of the pitched roof members while at ground level.

32. A method according to claim 19 further comprising connecting the plurality of end post supports to ends of the pitched roof members from an elevated platform.

33. A method according to claim 24 further comprising removably fastening the plurality of gable posts supports to the pitched roof member while at ground level.

34. A method according to claim 24 further comprising removably fastening the plurality of gable posts supports to the pitched roof member from an elevated platform.

35. A combination of a pitched roof of a building and a temporary guardrail system therefor comprising:

a pitched roof comprising a plurality of pitched roof members;

said temporary guardrail system comprising a plurality of end post supports each comprising a body having a first segment removably fastened to an end of a respective pitched roof member and having a second segment extending outwardly from the respective pitched roof member, a post receiver connected to an upper end of the second segment of said body, and a stabilizer carried by said body for extending against an adjacent wall portion below the pitched roof;

a respective post carried by the post receiver of each end post support; and rail members connected between adjacent posts.

36. A combination according to claim 35 wherein the first segment of said body has a plurality of openings therein to receive respective removable fasteners to temporarily secure said body to a side of the end of the respective pitched roof member.

37. A combination according to claim 35 wherein said stabilizer comprises:

an elongate stabilizer member; and a stabilizer receiver connected to said body for adjustably receiving said elongate stabilizer member therein.

38. A combination according to claim 37 further comprising a transverse stabilizer member connected to an end of said elongate stabilizer member.

39. A combination according to claim 35 further comprising a kick member carried by the upper end of the second segment.

40. A combination according to claim 35 further comprising:

a plurality of gable post supports, each comprising a gable body having a first end for removably fastening to a pitched roof member along a gable portion thereof, and a post receiver carried by said gable body;

a respective post carried by the post receiver of each gable post support; and rail members connected between adjacent posts.

41. A combination according to claim 40 wherein said gable body comprises a gable plate to be removably connected to the pitched roof member, and an elongate gable member extending outwardly from said gable plate.

42. A combination according to claim 41 wherein said post receiver is selectively positionable along said elongate gable member.

43. A combination according to claim 40 wherein each gable post support further comprises a gable stabilizer carried by a second end of said gable body for extending against an adjacent wall portion below the pitched roof.

44. A combination according to claim 43 wherein said gable stabilizer comprises:

an elongate stabilizer member; and a stabilizer receiver connected to said gable body for adjustably receiving said elongate stabilizer member therein.

45. A combination according to claim 44 further comprising a transverse stabilizer member connected to an end of said elongate stabilizer member.

46. A method of installing a temporary guardrail system on a pitched roof of a building, the pitched roof comprising a plurality of pitched roof members, the method comprising:

connecting a plurality of end post supports to ends of respective pitched roof members, each end post support comprising a body having a first segment removably fastened to the end of the respective pitched roof member and having a second segment extending outwardly from the respective pitched roof member, a post receiver connected to an upper end of the second segment of the body, and a stabilizer carried by the body and extending against an adjacent wall portion below the pitched roof;

connecting a respective post to the post receiver of each end post support; and connecting rail members between adjacent posts.

47. A method according to claim 46 wherein the first segment of the body has a plurality of openings therein to receive respective removable fasteners to temporarily secure the body to a side of the end of the respective pitched roof member.

48. A method according to claim 46 wherein the stabilizer comprises an elongate stabilizer member; and further comprising adjustably receiving the elongate stabilizer member in a stabilizer receiver connected to the body.

49. A method according to claim 48 further comprising connecting a transverse stabilizer member to an end of the elongate stabilizer member.

50. A method according to claim 46 further comprising connecting a kick member to the upper end off the second segment of the body.

51. A method according to claim 46 further comprising removably fastening a plurality of gable post supports to the pitched roof members along a gable portion thereof.

* * * * *

UNITED STATES PATENT AND TRADEMARK OFFICE

CERTIFICATE OF CORRECTION

PATENT NO. : 7,127,868 B2
APPLICATION NO. : 10/613510
DATED : October 31, 2006
INVENTOR(S) : Purvis et al.

It is certified that error appears in the above-identified patent and that said Letters Patent is hereby corrected as shown below:

| | |
|---|---|
| Column 4, Line 43 | Delete: "accoimnodate"<br>Insert: -- accommodate -- |
| Column 4, after Line 65 | Paragraph was omitted.<br><br>Insert: -- The guardrail system **20** also illustratively comprises a transverse stabilizer member **54** connected to an end of the elongate stabilizer member **52**. The transverse stabilizer member **54** may include a T-shaped connector **55**, and a transverse stabilizer member extender **56**. The T-shaped connector **55** may be a tube for receiving an end of the stabilizer member **50** and for receiving the transverse stabilizer extender **56**. More specifically, the T-shaped connector **55** may have a size slightly larger than the size of the stabilizer member **50** and of the transverse stabilizer member extender **56**, and an inner shape substantially similar to the shape of the outer periphery of the stabilizer member and of the transverse stabilizer member. -- |
| Column 5, Line 37 | Delete: "or wood"<br>Insert: -- of wood -- |
| Column 5, Line 37 | Delete: "illustratively **76**"<br>Insert: -- **76** illustratively -- |
| Column 7, Line 39 | Delete: "comprises; "<br>Insert: -- comprises: -- |
| Column 9, Line 2 | Delete: "comprises; "<br>Insert: -- comprises: -- |

UNITED STATES PATENT AND TRADEMARK OFFICE

CERTIFICATE OF CORRECTION

PATENT NO. : 7,127,868 B2
APPLICATION NO. : 10/613510
DATED : October 31, 2006
INVENTOR(S) : Purvis et al.

It is certified that error appears in the above-identified patent and that said Letters Patent is hereby corrected as shown below:

Column 10, Line 60 Delete: "end off"
Insert: -- end of --

Signed and Sealed this

Seventeenth Day of July, 2007

JON W. DUDAS
*Director of the United States Patent and Trademark Office*